US008947188B2

(12) United States Patent
Hammer et al.

(10) Patent No.: US 8,947,188 B2
(45) Date of Patent: Feb. 3, 2015

(54) TAP CHANGER AND VACUUM INTERRUPTER FOR SUCH A TAP CHANGER

(75) Inventors: Christian Hammer, Regensburg (DE); Wolfgang Albrecht, Wenzenbach (DE); Christian Pircher, Lappersdorf (DE); Sebastian Rehkopf, Regensburg (DE); Andreas Sachsenhauser, Mallersdorf-Pfaffenberg (DE); Konrad Raedlinger, Tegernheim (DE); Andreas Stelzer, Berlin (DE); Joerg Teichmann, Alzenau (DE); Andreas Lawall, Berlin (DE); Roman Renz, Berlin (DE); Astrid Renz, legal representative, Berlin (DE); Sylvio Kosse, Erlangen (DE); Werner Hartmann, Weisendorf (DE); Norbert Wenzel, Erlangen (DE)

(73) Assignee: Maschinenfabrik Reinhausen GmbH, Regensburg (DE)

( * ) Notice: Subject to any disclaimer, the term of this patent is extended or adjusted under 35 U.S.C. 154(b) by 0 days.

(21) Appl. No.: 14/000,435

(22) PCT Filed: Mar. 2, 2012

(86) PCT No.: PCT/EP2012/053587

§ 371 (c)(1),
(2), (4) Date: Oct. 21, 2013

(87) PCT Pub. No.: WO2012/136423

PCT Pub. Date: Oct. 11, 2012

(65) Prior Publication Data

US 2014/0085028 A1 Mar. 27, 2014

(30) Foreign Application Priority Data

Apr. 2, 2011 (DE) ..... 10 2011 015 922

(51) Int. Cl.
*H01H 21/12* (2006.01)
*H01H 33/66* (2006.01)

(Continued)

(52) U.S. Cl.
CPC ..... *H01F 29/04* (2013.01); *H01H 9/0038* (2013.01); *H01H 33/6647* (2013.01); *H01H 33/16* (2013.01); *H01H 2033/6668* (2013.01)
USPC ..... 336/150; 218/10; 323/255

(58) Field of Classification Search
CPC . H01H 33/66; H01H 33/6661; H01H 33/122; H01H 9/0038; H01H 9/0005; H01F 29/04; H01F 29/025; H02H 7/0055
USPC ..... 336/150; 218/8–21, 118–142; 200/19.2, 200/19.21, 19.25; 323/254–258, 340
See application file for complete search history.

(56) References Cited

U.S. PATENT DOCUMENTS 3,405,245 A 10/1968 Ito et al.
3,662,253 A * 5/1972 Yamamoto ..... 323/343

(Continued)

FOREIGN PATENT DOCUMENTS

| | | | |
|---|---|---|---|
| DE | 2021575 | A | 12/1971 |
| DE | 19756308 | B | 3/1999 |
| DE | 102006033422 | B | 11/2007 |
| DE | 102010024255 | A | 12/2011 |
| DE | 102011008959 | B | 2/2012 |
| EP | 0258614 | A | 3/1988 |

*Primary Examiner* — Alexander Talpalatski
*Assistant Examiner* — Joselito Baisa
(74) *Attorney, Agent, or Firm* — Andrew Wilford

(57) ABSTRACT

The invention relates to a tap changer for the interruption-free switchover between winding taps of a tap-changing transformer. Furthermore, the present invention relates to a novel vacuum interrupter which is particularly suitable for such a tap changer. The tap changer according to the invention is based on the general concept of combining in each case one main contact (V1) and one mechanical switching means (U1), connected in series therewith, of a first load branch and an additional resistive contact (V3) of a second load branch in only a single vacuum interrupter (1) with a common housing (5). The vacuum interrupter (1) according to the invention is furthermore based on the general inventive concept of replacing the functionalities of two required vacuum interrupters in accordance with the prior art and an additional mechanical switching means with a single vacuum interrupter (1) according to the invention by virtue of combining the design of a vacuum interrupter (1) with a plurality of moveable contact systems (I, II, III), which are arranged in separate vacuum interrupter chambers (2, 3, 4) which are sealed with respect to one another.

10 Claims, 2 Drawing Sheets

(51) Int. Cl.

| | |
|---|---|
| ***G05F 1/14*** | (2006.01) |
| ***H01F 29/04*** | (2006.01) |
| ***H01H 9/00*** | (2006.01) |
| ***H01H 33/664*** | (2006.01) |
| *H01H 33/16* | (2006.01) |
| *H01H 33/666* | (2006.01) |

(56) References Cited

U.S. PATENT DOCUMENTS

| | | | | |
|---|---|---|---|---|
| 3,819,892 | A * | 6/1974 | Rathbun | 218/118 |
| 6,856,122 | B2 * | 2/2005 | Dohnal et al. | 323/258 |
| 8,367,951 | B2 * | 2/2013 | Nilsson et al. | 200/6 R |

* cited by examiner

TAP CHANGER AND VACUUM INTERRUPTER FOR SUCH A TAP CHANGER

CROSS REFERENCE TO RELATED APPLICATIONS

This application is the US-national stage of PCT application PCT/EP2012/053587 filed 2 Mar. 2012 and claiming the priority of German patent application 102011015922.3 itself filed 2 Apr. 2011.

The invention relates to a tap changer for uninterrupted changeover between winding taps of a tapped transformer.

The present invention additionally relates to a novel vacuum-switching tube particularly suitable for such a tap changer.

A tap chamber having in total four vacuum-switching tubes per phase is known from DE 20 21 575. Provided in each of the two load branches are a respective vacuum-switching tube as main contact and a respective further vacuum-switching tube, in series connection with a switchover resistor, as resistance contact.

In the case of an uninterrupted load changeover from the previous winding tap n to a new, preselected winding tap n+1 initially the main contact of the side to be switched off is opened and thereupon the resistance contact of the side taking over closes so that a compensating current limited by the switchover resistors flows between the two taps n and n+1.

After the previously closed resistance contact of the side switching off has opened the main contact of the side taking over then closes so that the entire load current is conducted from the new winding tap n+1 to the load diverter; the changeover is concluded.

However, in various cases of use of such known tap changers with vacuum-switching tubes for regulation of power transformers a high surge voltage strength, up to 100 kV and significantly thereabove, is required. Such undesired surge voltages, the level of which is substantially attributable to the construction of the tapped transformer and of the winding parts between the individual taps, are on the one hand lightning surge voltages resulting from lightning strikes in the mains. On the other hand, switching surge voltages caused by unpredictable switching surges in the mains to be regulated can also arise.

In a case of an inadequate surge voltage strength of the tapped transformer on the one hand a transient tap short-circuit can arise if the vacuum-switching tube in the load branch not conducting the load current breaks down.

This leads in many cases in the design of the switching paths and thus particularly also the vacuum-switching tubes to over-dimensioning so that these reliably withstand the described voltage loading. Not only the small constructional space currently available in modern apparatus, but also economics as well as serviceability of such vacuum-switching tubes make such over-dimensioning appear disadvantageous.

A tap changer is therefore proposed in DE 10 2010 024 255 (not prior-published), in which a first winding tap of a first main current branch is connected with a load diverter by way of a series connection consisting of a first mechanical changeover switch and a first switching means, i.e. a vacuum-switching tube or alternatively a semiconductor component. In an analogous mode of construction symmetrical with respect thereto a second winding tap of a second main current branch is similarly connected with the load diverter by way of a series connection consisting of a second mechanical changeover switch and a second switching means, i.e. a second vacuum-switching tube or alternatively a second semiconductor component. In addition, branched off between the first winding tap and the first mechanical changeover switch is a first auxiliary current branch with an included resistor, by means of which an electrical connection with the second mechanical changeover switch of the second main current branch is producible, and branched off between the second winding tap and the second mechanical changeover switch is a second auxiliary current branch with a further included resistor, by means of which an electrical connection with the first mechanical changeover switch of the first main current branch is producible.

In other words: present in the known tap changer in each main current branch and auxiliary current branch is thus a mechanical changeover switch that is connected in series with the respective vacuum-switching tube and that ensures a complete electrical isolation of the respective winding tap, which is not connected, and thus a high surge voltage strength.

All tap changers known from the prior art require a plurality of vacuum-switching tubes and additional mechanical switching means per phase, which due to the high demand for space by the individual switching means and the accompanying constructional and mechanical outlay is disadvantageous and, above all, costly. This is not least because for a changeover process a multiplicity of necessary individual components is required in the tap changers for realization of the switching sequence, which components then have to interact in only a few tenths of a second in a changeover process precisely defined in terms of time.

OBJECT OF THE INVENTION

It is therefore the object of the present invention to indicate a tap changer for uninterrupted changeover between winding taps of a tapped transformer that enables a reduction in the complexity and in the required individual components, in that case, in particular, makes mechanical switching means redundant and, in addition, has a high surge voltage strength. Moreover, it is an object of the present invention to indicate a vacuum-switching tube that is usable particularly advantageously for such a developed tap changer.

SUMMARY OF THE INVENTION

These objects are fulfilled by a tap changer as well as by a vacuum-switching tube based on the general idea of, in each instance, combining a main contact and a mechanical switching means serially connected therewith of a first load branch and an additional resistance contact of a second load branch in only a single vacuum-switching tube with a common housing. The vacuum-switching tube according to the invention is in addition based on the general inventive idea of replacing, by the combination of the constructional form of a vacuum-switching tube with several movable contact systems arranged in separate and mutually sealed vacuum switching chambers, the functionalities of two required vacuum-switching tubes according to the prior art and an additional mechanical switching means by a single vacuum-switching tube according to the invention. In other words: In the case of the vacuum-switching tube according to the invention the previous separately required switching means, namely the two vacuum-switching tubes switching under load and the one further mechanical switching means are no longer, as in the prior art, executed as individual components and installed in the tap changer, but are combined in now a single vacuum-switching tube with vacuum switching paths arranged in several separate vacuum switching chambers. The vacuum-switching tube in that case makes it possible to now functionally replace not only the mechanical switching means of a changeover switch, but also a mechanical on and off switch by a vacuum switching path.

The dielectric strength of the novel vacuum-switching tube is increased in that the individual vacuum switching paths of the several contact systems are arranged in separate, i.e. mutually sealed, vacuum switching chambers, but in a common housing. In other words: The risk of differences in potential existing between the different contact systems, which could lead to an overlapping arc, are solved in accordance with the invention by the fact that several separate vacuum switching chambers are provided in which the contact systems are arranged to be respectively electrically separated from one another.

Vacuum-switching tubes with two contact points are known per se.

DE 3344367 relates to a vacuum-switching tube with two contact pairs, which are electrically connected in series and which are simultaneously actuatable, in a single vacuum chamber.

DE 197 56 308 C1 relates to a similar vacuum-switching tube with two switching paths arranged on a common axis, wherein internally disposed contact compression springs are provided.

EP 0 258 614 B1 describes the combination of a vacuum-switching tube and a specific connection at a tap changer. In this case, several switching paths are arranged in one vacuum chamber, which requires a complicated construction of the vacuum-switching tube with annular fixed contacts.

Finally, DE 10 2006 033 422 B3 describes a further vacuum-switching tube with multiple functionalities, wherein here, as well, annular fixed contacts as well as internally disposed contact compression springs are required.

BRIEF DESCRIPTION OF THE DRAWING

The invention will be explained in more detail by way of example in the following with reference to figures, in which.

SPECIFIC DESCRIPTION OF THE INVENTION

Figure 1:
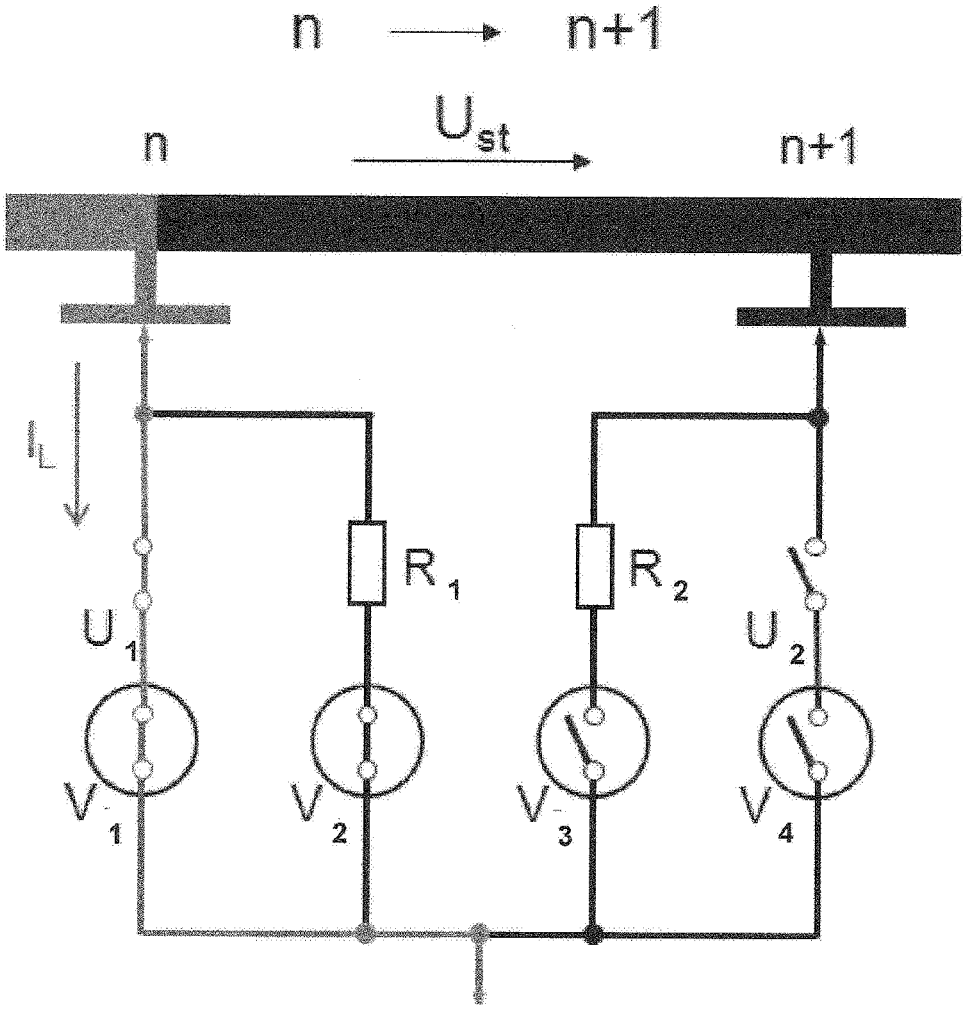
FIG. 1 shows a tap changer according to the prior art.

A tap changer known from the prior art is shown in FIG. 1. It comprises a first load branch in which a vacuum-switching tube $V_1$ acting as a main contact and a mechanical changeover switch $U_1$ connected in series therewith, as well as in parallel therewith a switchover resistor $R_1$ and a vacuum-switching tube $V_2$ acting as a resistance contact, are disposed. The second load branch has, entirely analogously, a vacuum-switching tube $V_4$ and a mechanical changeover switch $U_2$ connected in series therewith as well as in parallel therewith a further switchover resistor $R_2$ and a vacuum-switching tube $V_3$ acting as a resistance contact. The known tap changer thus has two vacuum-switching tubes per load branch, thus four vacuum-switching tubes per phase. The starting position, in which the tap n is connected, corresponds with the setting, which is illustrated in FIG. 1, of the individual switching elements. The changeover is carried out in the following steps:

vacuum-switching tube $V_1$ vacuum-switching tube $V_3$ closes vacuum-switching tube $V_2$ opens vacuum-switching tube $V_4$ closes; the changeover is concluded.

Figure 2:
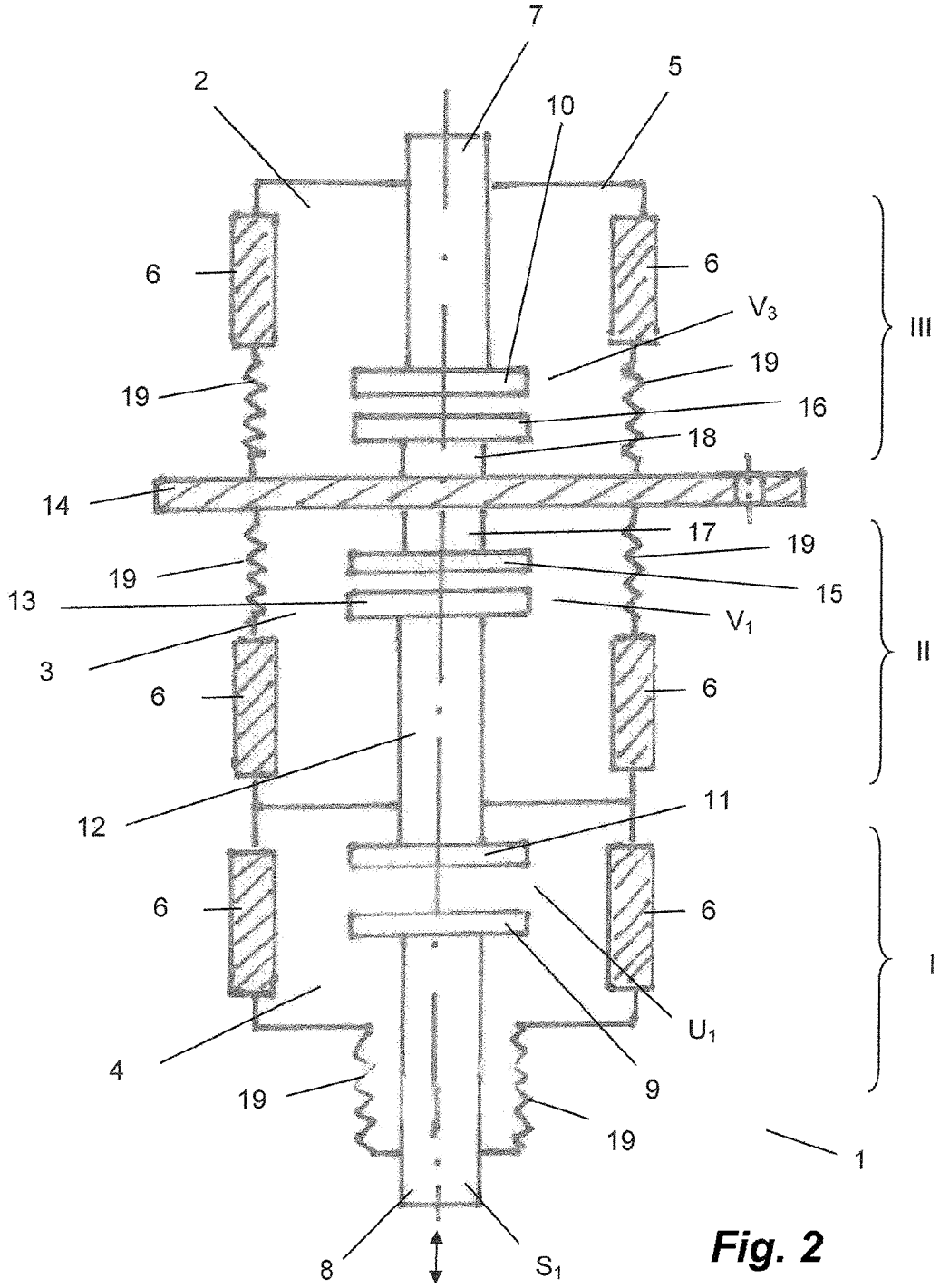
FIG. 2 shows a vacuum-switching tube according to the invention for a tap changer in a schematic illustration.

FIG. 2 shows a vacuum-switching tube 1 according to the invention with a first contact system I, a second contact system II and a third contact system III, which are all constructed as vacuum switching paths. In addition, the contact systems I, II, and III are arranged to be physically separate in, respectively, separate vacuum switching chambers 2, 3 and 4, but in a common housing 5 enclosing all contact systems I, II, and III. Several insulating ceramic members 6 are respectively provided in the lateral wall region of the individual vacuum switching chambers 2, 3 and 4. Provided centrally in prolongation of the rotational symmetrically longitudinal axis $S_1$ is an upper, fixed plunger 7 and, at the opposite end, a lower, movable plunger 8, which in the interior of the housing 5 respectively carry contact members 9 and 10 in a manner known per se. The contact member 9 can be brought into electrical connection with a fixed contact 11 separately and independently by actuation of the movable plunger 8. The fixed contact 11 is in that case arranged at a fixed, electrically conductive plunger 12, which is provided in the interior of the housing 5 and which penetrates the separation between the vacuum switching chambers 3 and 4 in prolongation of the longitudinal axis $S_1$ and has a further fixed contact 13 at its end opposite the fixed contact 11. The sealed separation between the vacuum switching chambers 2 and 3 is ensured by an electrically conductive plate 14, which is constructed to the displaceable in the longitudinal direction of the axis $S_1$ and on both sides of which a further fixed contact member 15 and 16 is fastened by way of a respective electrically conductive web 17 or 18. Thus, through vertical displacement of the plate 14 the fixed contact 16 can be connected with the fixed contact 10 or the fixed contact 15 with the fixed contact 13. Provided in the region of the wall of the housing 5 are, here, bellows 19 that are known according to the prior art and that allow the plate 14 a vertical freedom of movement. The known contact springs co-operating with the plunger 8 are not illustrated here for reasons of clarity.

If the vacuum-switching tube 1 described in FIG. 2 is applied to a tap changer of FIG. 1 then according to the invention the two previously separate switching elements V1, V3 and U1 or V2, V4 and U2 are now combined in a single vacuum-switching tube 1 with the separately controllable contact systems I, II, and III. If the plunger 7 of the vacuum-switching tube 1 depicted in FIG. 2 is electrically conductively connected by way of a resistor R2 with the winding tap n+1, the electrically conductive plate 14 with the load diverter LA and the lower plunger 8 with the winding tap n then mechanical realization of the tap changer described in FIG. 1 can be achieved in particularly simple manner.

The invention claimed is:

1. A tap changer with vacuum-switching tubes for uninterrupted changeover between winding taps of a tapped transformer, wherein two load branches are provided for each phase to be switched, each load branch comprises a vacuum-switching tube acting as a main contact and mechanical switching means connectable in series therewith, an auxiliary current branch connectable in parallel with the corresponding load branch is provided for each phase to be switched, each auxiliary current branch comprises at least one switchover resistor and in series a further vacuum switching contact acting as an auxiliary contact, and not only the load branches, but also the auxiliary current branches of the two load branches are connectable with a common load diverter, the vacuum switching contact, which acts as main contact, and the mechanical switching means arranged in series therewith of the first load branch and the vacuum switching contact, which acts as auxiliary contact, of the second load branch are constructionally combined in a single vacuum-switching tube with a common housing, the vacuum switching contact, which acts as main contact, and the mechanical switching means arranged in series therewith of the second load branch and the vacuum switching contact, which acts as auxiliary contact, of the first load branch are combined in a further single vacuum-switching tube with a common housing and a respective separate hermetically sealed vacuum switching chamber is provided within the common housing for each vacuum switching contact and for each mechanical switching means.

2. The tap changer according to claim 1, wherein the vacuum switching contacts and the further mechanical switching means, which are provided in the separate vacuum switching chambers, each form a respective separate contact system I, II and III.

3. The tap changer according to claim 1, wherein the first contact system I forms the mechanical switching means.

4. The tap changer according to claim 1, wherein the second contact system II forms the vacuum switching contact.

5. The tap changer according to claim 1, wherein the third contact system III forms the vacuum switching contact.

6. A vacuum-switching tube for a tap changer according to claim 1, wherein a common housing enclosing the entire vacuum-switching tube is provided and that provided within the housing is a plurality of contact systems, which are arranged along a common longitudinal axis and which are arranged in each instance to be separated physically and hermetically in a separate vacuum switching chamber.

7. The vacuum-switching tube according to claim 6, wherein the first contact system I comprises a lower plunger, which is movable along the longitudinal axis and to which is fastened a contact member contractible by a contact member fastened to a fixed plunger.

8. The vacuum-switching tube according to claim 7, wherein several insulating ceramic members are provided in each vacuum switching chamber in the region of the lateral wall of the housing.

9. The vacuum-switching tube according to claim 6, wherein the second contact system II has at the opposite end to the contact member a contact that is similarly fastened to the plunger and that is contractible with a contact member fastened by way of a web to an electrically conductive plate displaceable along the longitudinal axis.

10. The vacuum-switching tube according to claim 6, wherein the third contact system III comprises a contact member, which is fastened to an upper fixed plunger and which is contractible with a contact member fastened by way of a web to the electrically conductive plate displaceable along the longitudinal axis $S_1$.

* * * * *